US011110339B2

(12) United States Patent
Höpcke

(10) Patent No.: US 11,110,339 B2
(45) Date of Patent: Sep. 7, 2021

(54) SPORTS EQUIPMENT

(71) Applicant: UNLCKED UG (haftungsbeschränkt), Hamburg (DE)

(72) Inventor: Klaas Gunnar Höpcke, Hamburg (DE)

(73) Assignee: UNLCKED UG (haftungsbeschränkt), Hamburg (DE)

( * ) Notice: Subject to any disclaimer, the term of this patent is extended or adjusted under 35 U.S.C. 154(b) by 0 days.

(21) Appl. No.: 16/880,445

(22) Filed: May 21, 2020

(65) Prior Publication Data

US 2020/0368604 A1 Nov. 26, 2020

(30) Foreign Application Priority Data

May 23, 2019 (EP) ..... 19176118

(51) Int. Cl.

| | |
|---|---|
| ***A63C 10/12*** | (2012.01) |
| ***B63B 32/40*** | (2020.01) |
| ***A63C 9/085*** | (2012.01) |
| ***A63C 10/06*** | (2012.01) |

(52) U.S. Cl.

CPC ..... *A63C 10/12* (2013.01); *A63C 9/08592* (2013.01); *A63C 10/06* (2013.01); *B63B 32/47* (2020.02)

(58) Field of Classification Search

CPC ..... B63B 32/45; A63C 10/12

See application file for complete search history.

(56) References Cited

U.S. PATENT DOCUMENTS 4,528,924 A * 7/1985 Marker ..... B63B 32/45 114/39.19
4,846,744 A * 7/1989 Love ..... B63B 32/45 441/75
4,960,063 A * 10/1990 Bontemps ..... B63B 32/45 114/39.19
5,378,181 A * 1/1995 Sewell ..... B63B 32/45 441/75

(Continued)

FOREIGN PATENT DOCUMENTS

EP 3006094 A1 4/2016
EP 3741435 A1 * 11/2020 ..... A63C 9/08592

(Continued)

*Primary Examiner* — Jeffrey J Restifo

(74) *Attorney, Agent, or Firm* — Erickson Kernell IP, LLC; Kent R. Erickson

(57) ABSTRACT

A release mechanism is provided for releasably connecting a strap to sports equipment. The strap is secured at a first end to the sports equipment and at a second end to the release mechanism. The release mechanism has a fastening part releasably connected to an engagement element. The engagement element interacts with a fastening part bail element that is pivotable about a pivot axle between a release position and an engaged position with the engagement element. The bail element can be secured in the engaged position by a securing element. The securing element and bail element are secured to the fastening part such that the distance between the pivot axle of the bail element and the securing element changes when a tensile load is applied to the bail element. The securing element releases the bail element when a defined release tensile force is exerted on the bail element.

20 Claims, 5 Drawing Sheets

(56) References Cited

U.S. PATENT DOCUMENTS 5,558,552 A * 9/1996 Namur ..... B63B 32/45 441/75
5,743,550 A * 4/1998 Frohwein ..... A63C 9/0802 280/612
5,762,357 A * 6/1998 Ratzek ..... A63C 10/08 280/607
5,893,785 A * 4/1999 Baldwin, III ..... B63B 32/45 441/75
6,007,394 A * 12/1999 Kagan ..... B63B 32/45 441/74
6,209,904 B1 * 4/2001 Schnitzhofer ..... A63C 10/12 280/14.22
6,237,520 B1 * 5/2001 Sisseren ..... B63B 32/45 114/39.19
6,428,032 B1 * 8/2002 Humbel ..... A63C 10/08 280/14.22
2009/0174178 A1 7/2009 Lenhart
2011/0018233 A1 * 1/2011 Senner ..... A63C 9/0885 280/623
2012/0227651 A1 * 9/2012 Kuntzel ..... A63C 17/262 114/39.19
2012/0313350 A1 * 12/2012 Trudel ..... A63C 10/12 280/633
2014/0162511 A1 * 6/2014 Ball ..... A63C 10/145 441/65
2016/0158634 A1 * 6/2016 Romashev ..... A63C 10/06 280/809
2019/0358516 A1 * 11/2019 Barden ..... A63C 9/0802
2020/0368604 A1 * 11/2020 Hopcke ..... B63B 32/45

FOREIGN PATENT DOCUMENTS

FR 3096340 A1 * 11/2020 ..... B63B 32/45
WO 2007090310 A1 8/2007
WO 2009092596 A2 7/2009

* cited by examiner

SPORTS EQUIPMENT

CROSS-REFERENCE TO RELATED APPLICATIONS

This application claims priority from European Application EP19176118.8, filed May 23, 2019, the disclosure of which is hereby incorporated herein in its entirety by reference.

BACKGROUND OF THE INVENTION

The present invention relates to sports equipment with a device for fastening an object or a person to the sports equipment. Such sports equipment comprises, e.g. surfboards, skis, ski poles, snowboards, sailboats, sleds, or any type of sports equipment that reaches a certain speed and has straps or belts, or such securing devices, with which a person or an object is secured to the sports equipment during its use.

It is known with these types of sports equipment that a strap forming a loop is attached at its first end to the body of the sports equipment while the second end of the strap is releasably attached to the body by means of a release mechanism. A loop is basically formed in this manner by the strap and the body of the sports equipment, that encompasses a body part, e.g. a foot in the case of a surfboard, thus securing it to the sports equipment. Such a release mechanism has the advantage that the strap can be released from the body at its second end if a certain releasing force has been exceeded, e.g. in the case of an accident. The release mechanism thus significantly improves the safety when using the sports equipment. The release mechanism normally has a fastening part and an engagement part, which can be releasably connected to one another, wherein one of the two parts is attached to the body of the sports equipment and the other part is attached to the end of the strap.

SUMMARY OF THE INVENTION

The object of the invention is to create sports equipment of this type that has a release mechanism with a simple and reliable design. This object is achieved with a piece of sports equipment according to claim 1. Advantageous developments of the invention are the subject matter of the dependent claims. The invention also relates to a device for securing a person or an object to the sports equipment.

According to the invention, the engagement part has an engagement element that interacts in a form fitting manner with a bail element of the fastening part, wherein the bail element can be pivoted about a pivot axle on the fastening part between an open position that releases the engagement element and an engaged position in which it engages with the engagement element, wherein the engaged position of the bail element can be adjusted by a securing element. In this manner, the connection of the engagement element and the bail element can be secured by the securing element. According to the invention, the securing element as well as the bail element are secured to the fastening part, wherein one of the two elements is secured to the fastening part via a spring mechanism, such that the distance of the pivot axle in the bail element to the securing element changes when a tensile load is applied to the bail element, wherein the securing element is located on the bail element such that it releases the bail element when a defined release force to the bail element is exceeded. The release function is therefore defined by the fastening part, in which the bail element as well as the securing element can be moved toward one another via the spring mechanism. The travel of the spring up to when the release force has been reached results in the securing element leaving its securing position in relation to the bail element and releasing the bail element from the securing element. This spring travel can be adjusted by selecting different spring elements in the spring mechanism.

Optionally, it is possible and advantageous to adjust the spring force of the spring mechanism, and thus the release force, via an adjustment mechanism. In this manner, a single spring element can be used in the spring mechanism to obtain different release forces. The adjustment mechanism can thus apply a certain tension to the spring element, for example, such that the release force is increased or reduced. The release force can thus be adjusted to a specific individual for the sports equipment.

The securing element can preferably be moved, e.g. pivoted, between a receiving position and a securing position. In this manner, when the bail element is pivoted from the open position to the engaged position, the securing element is moved to the receiving position to be able to therefore receive the bail element. It is subsequently moved by hand or by means of a spring into its securing position, in which it encompasses, or secures, the bail element. The securing element is preferably pulled or pushed by a spring into its securing position.

The securing element can preferably be moved, e.g. pivoted, between two securing positions, i.e. between a first securing position in which the securing element secures the bail element in its engaged position independently of the force acting on the bail element, and a second securing position in which the bail element is released from the securing element when the release force is exceeded, i.e. the release mechanism is activated. The first securing position serves to deactivate the release mechanism, which may be desired in certain situations.

As a matter of course, the strap can be flexible, e.g. made of a textile webbing or a flexible metal, plastic, or hybrid strap. It can also, however, be rigid, and integrated in an element, e.g. a shoe or glove. It is thus also appropriate for use with rigid ski boots or snowboard boots.

The fastening part can preferably be attached to the body, and the engagement part attached to the end of the strap. The engagement part is the technically substantially simpler part, which can be in the form of a ring, loop, hook, or rectangular torus, in particular the last of these, such that it is then very simple for the bail element to pass through the ring or rectangular torus. The fastening part, in contrast, has the release mechanism, and is therefore somewhat larger and more complicated than the engagement part, such that it makes sense to secure this part to the body of the sports equipment.

The device can be secured to the sports equipment, e.g. by means of a mounting plate, or preferably by means of a mounting hinge, the first half of which is attached to the body, and the second part of which, which can pivot in relation thereto, forms a releasable connection, in particular, that secures the fastening part to its housing, for example. The mounting hinge can have a rigid pivot axle or a film hinge, via which the two parts are pivotally connected to one another. The fastening part is then preferably, in particular releasably, attached to the second part of the mounting hinge with its housing, such that the fastening part can pivot in relation to the body of the sports equipment about the axis of the mounting hinge, and can thus follow the movement and/or deformation exerted on the strap. In this manner, it is ensured that the release force to the bail element is always directed uni-axially away from the spring mechanism, allowing for a defined release force.

If the engagement element is a rectangular torus, a somewhat wider bail element can pass through it, thus resulting in a very defined and reliable engagement connection.

In an advantageous development of the invention, the fastening part specifically has an oblong housing that has a lower fastening region that can be secured to the strap or the body, and an upper engagement region, that supports the pivot axle of the bail element. The housing also receives the spring mechanism and supports the securing element. The preferred embodiment protects the spring mechanism, and also offers a good basis, by means of the housing, for the transfer of force between the fastening region and the engagement region. The pivot axle of the bail element is preferably supported in or on the housing. This can take place, e.g. via oblong holes in the opposing side walls of the housing, which then enable the pivot axle of the bail element to be deflected upward when increasing force is applied to the engagement element, until the bail element is freed from the retaining region of the securing element, and thus released.

The spring mechanism preferably comprises at least one spring element, e.g. a helical spring, which is secured in the fastening region of the housing by means of a mounting bracket. The spring element is also connected to the pivot axle of the bail element in the engagement region of the housing. The spring element can thus readily encompass the pivot axle of the bail element, for example. Both the release mechanism and spring mechanism, e.g. a helical spring, are protected in the housing. The adjustment mechanism for adjusting the tension of the spring mechanism is then formed in the region of the mounting bracket. This is achieved, in particular, in that the lower mounting point for the spring element in the fastening region of the housing can be adjusted in the longitudinal direction of the spring element. In this manner, the tension applied to the spring element, and thus the release force, can be easily adjusted.

The adjustment mechanism can preferably comprise an adjustment axle, which is connected to the lower end of the spring element, and is inserted in oblong holes in the housing, such that it can be adjusted in the longitudinal direction of the housing. The adjustment axle is retained on a support profile, in particular a U-shaped support profile, which receives a threaded bolt in the middle in a non-rotatable manner, which extends through the center of the housing in the longitudinal direction from the support profile to the base of the housing. The threaded bolt then bears on the base or passes through a cross web formed at the lower end, which is secured to the housing in a direction transverse to the longitudinal direction. The threaded bolt can then be adjusted to a greater or lesser extent toward the base of the housing via an adjustment nut in the base region that can be actuated, which bears against the base or cross web, such that the spring element is tensioned to a greater or lesser extent. This overall adjustment mechanism comprising the components: adjustment axle, support profile, threaded bolt, base or cross web, and adjustment nut, forms the mount for the spring element. At the top, the spring element encompasses the pivot axle of the bail element. The tension of the spring element, and thus the release force, can therefore be adjusted by rotating the adjustment nut. Such an adjustment mechanism can be easily obtained technologically, is uncomplicated and operationally reliable, and is protected inside the housing. The lower, free end of the threaded bolt is preferably more or less flush with the base of the housing, depending on the setting.

As an alternative to the embodiment above, which has a fixed threaded bolt, the threaded bolt can also be rotatably retained on the support profile, and mesh, e.g., with an internal threading in the cross web. In this case, it would be possible to make an adjustment by turning the threaded bolt in the internal threading of the cross web. It then preferably has an adjustment contour on its free end, facing the base, e.g. a slot, cross slot, hexagonal socket, or hexagonal head, etc. In this manner, the adjustment bolt can be easily rotated away from the base of the housing, thus adjusting the release force.

The lower end of the threaded bolt is preferably secured in the longitudinal direction of the housing by means of a cross web secured to the housing, because, when this cross web is sized accordingly, it can effectively and reliably absorb the tensions acting on the spring element as well as the tensile forces acting on the bail element. The fastening web can be easily and reliably secured, e.g., in perforations in the side walls of the housing, and thus offers a good basis for introducing the forces specified above.

In principle it is possible to permanently attach the fastening element, or its body, to the second half of a mounting hinge, or directly to the body of the sports equipment. Preferably, however, the connection of the fastening part to the body is formed via a form fitting snap-locking system. This then preferably interacts with a side wall of the housing. Such a connection enables a quick release of the fastening part from the body, e.g. to release the strap or belt, or to adjust the adjustment mechanism. The housing is preferably in the form of an oblong rectangular or cylindrical metal housing, wherein the spring element extends in the longitudinal direction of the housing. In this manner, the release mechanism is securely protected against physical or chemical effects, e.g. from saltwater. In this case, the housing is preferably made of a light metal, e.g. aluminum, or fiber-reinforced plastic. This has not only a sufficient stability for receiving the release mechanism, but is also very light, and therefore does not significantly increase the overall weight of the sports equipment.

In the embodiment described above, only one end of the strap is attached to the body of the sports equipment by means of a release mechanism. It is of course possible to attach both ends of the strap to the sports equipment by means of a release mechanism. This is particularly advantageous when the forces to the belt or strap do not act in a direction perpendicular to the body, but at an angle, such that both ends of the strap are subjected to a greater tensile force. In this case, an increased releasing safety can be obtained when there is a release mechanism at both ends of the strap. This also makes it possible to remove the entire strap, e.g. for cleaning or replacement when it becomes worn.

Lastly, the strap can also be formed by a rigid securing element that can be integrated in a shell or shaped element encasing an object that is to be attached to the sports equipment, e.g. a boot or glove. The strap can be formed in this case by a structural element on the object that is to be attached to the body of the sports equipment.

The invention also relates to a device for fastening an object or a person to the sports equipment that has a strap and a release mechanism of the type described above.

It is clear to the person skilled in the art that the embodiments of the invention described above can be combined arbitrarily with one another.

The following terms are used synonymously: strap—belt—foot strap—(elastic or rigid) fastening element; securing element—securing bail.

BRIEF DESCRIPTION OF THE DRAWINGS

The invention shall be described below based on the schematic drawings, in which.

DETAILED DESCRIPTION OF THE PREFERRED EMBODIMENTS

Figure 1:
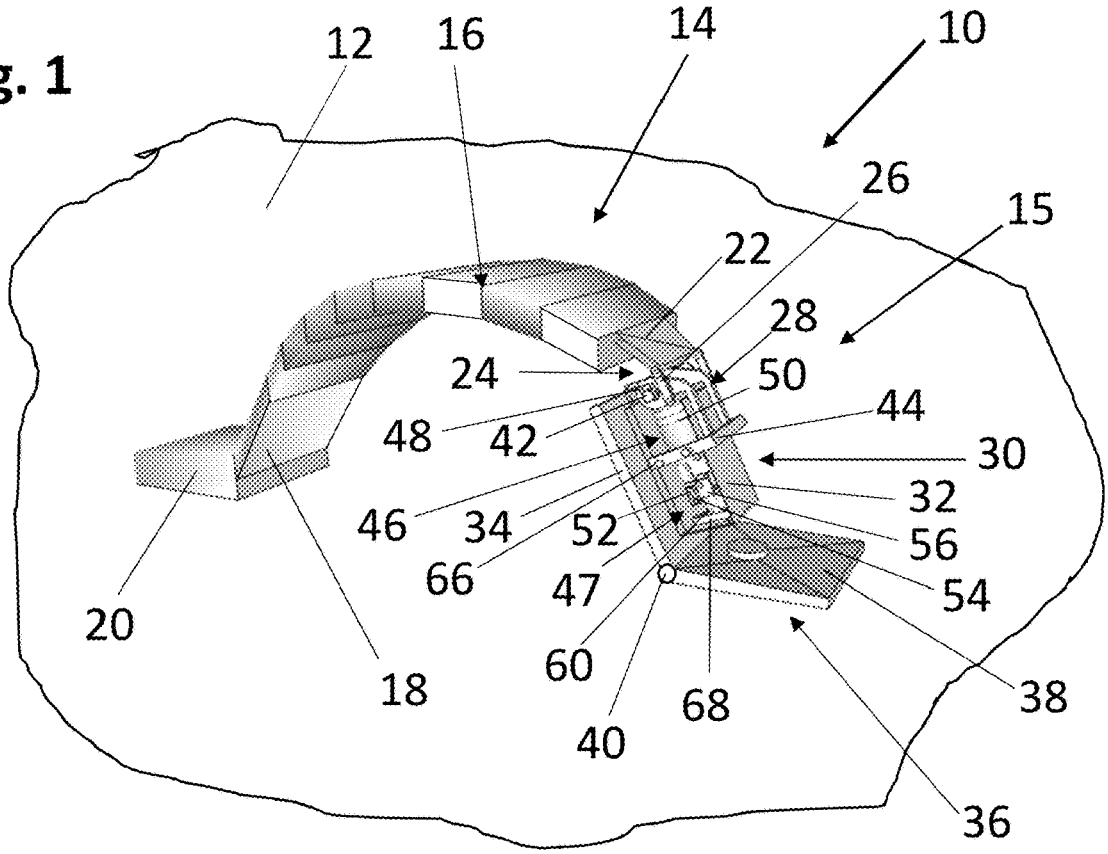
FIGS. 1 to 3 show three perspective views of a device for fastening an object or a person to a piece of sports equipment.

FIG. 1 shows a section of a piece of sports equipment 10, e.g. a surfboard, with a body 12, on which a device 14 for fastening a person's foot thereto is located. The device 14 has a strap 16, the first end 18 of which is secured with a mounting plate 20 to the body 12. On the second end 22, the strap 16 has an engagement part 24 comprising an engagement element 26 in the form of a rectangular torus. This engagement element 26 interacts with a bail element 28 located on a fastening part 30, which is secured by means of its housing 32 to the second half 34 of a mounting hinge 36, which is attached to the body 12 of the sports equipment 10 at its first half 38.

Figure 2:
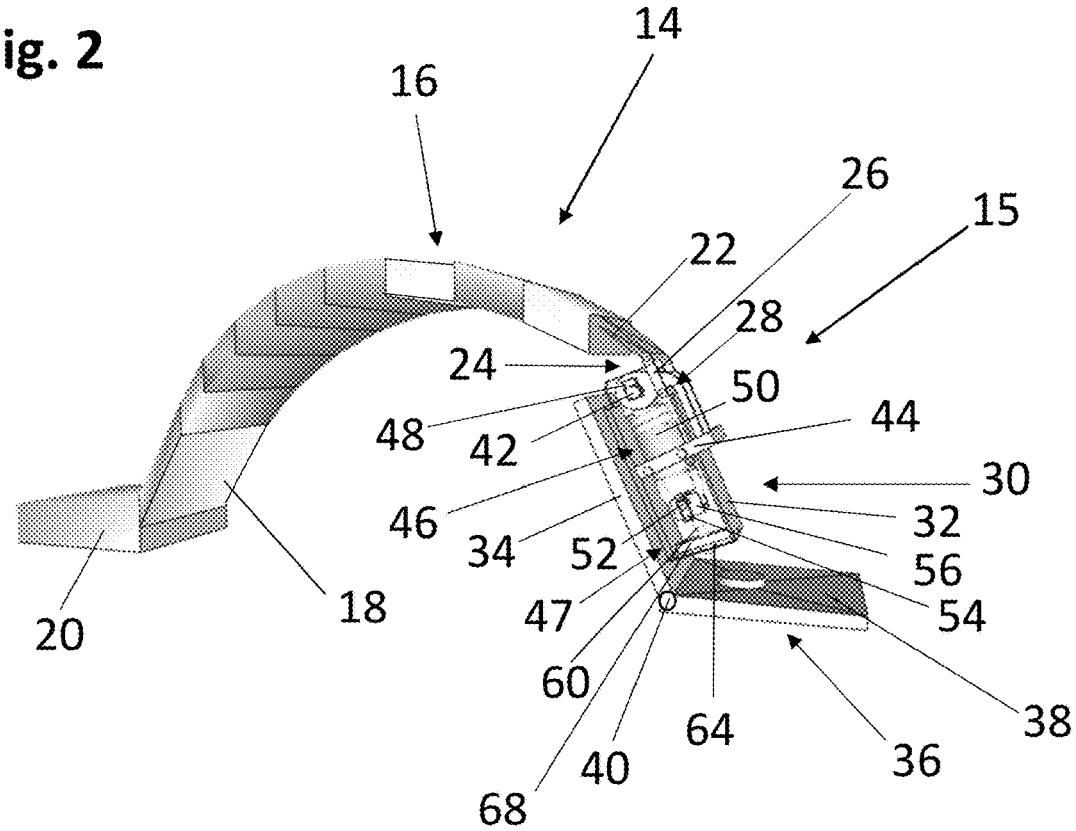
Figure 3:
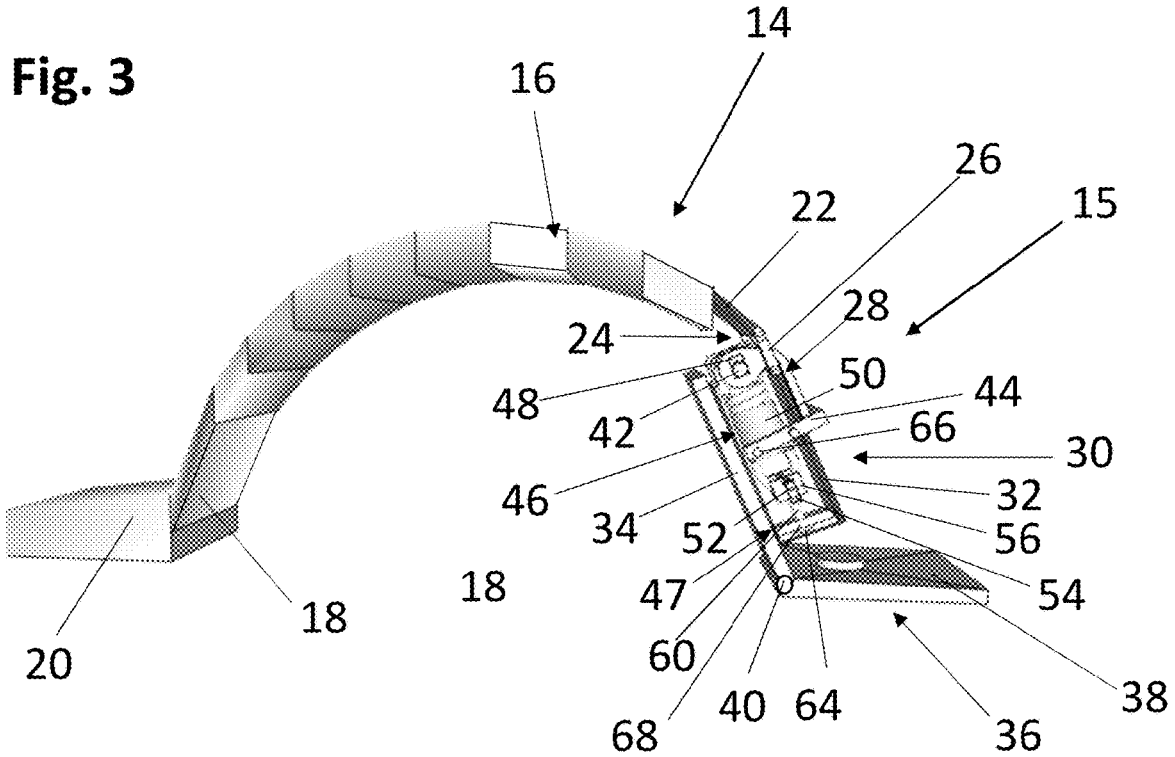

The engagement part 24 and the fastening part 30 collectively form a release mechanism 15, which functions such that when a high tensile force acts on the strap 16, the connection of the engagement part 24 and the fastening part 30 is released. The fastening part 30 can pivot about the pivot axle 40 of the mounting hinge 36 and can therefore follow the pulling direction of the strap 16, such that the force acting on the bail element 28 via the engagement element 26 is always directed axially, resulting in defined release forces. The bail element 28 is mounted on the fastening part 30 such that it can pivot about a pivot axle 42 between an open position, in which the engagement element 26 is released, and the depicted engaged position, which is secured by a bail-like securing element 44, hereinafter referred to as a securing bail. The housing 32 of the fastening part encompasses a spring mechanism 46, such that the pivot axle 42 of the bail element 28 can move in the longitudinal direction of the housing 32. The bail element 28 thus moves to a greater or lesser extent out of the securing bail 44 when different tensile forces are applied to the strap 16, such that the bail element 28 is released when a critical release force is reached, and thus pivots upward into its open position, at which point the engagement element is released, and releases the strap such that the person or object is released from the body of the sports equipment. The pivot axle 42, as can be better seen in FIG. 2, is inserted into first oblong holes 48 formed in the longitudinal direction I in opposing side walls of the housing 32. The spring mechanism 46 is formed by a helical spring 50 in this example, which encompasses the pivot axle 42 of the bail element. When a tensile force is applied to the strap 16, the pivot axle 42 is deflected upward in the first oblong hole 40, counter to the force of the spring mechanism, until the bail element 28 is released from the securing bail 44, pivots upward, and thus releases the engagement element 26.

Figure 4:
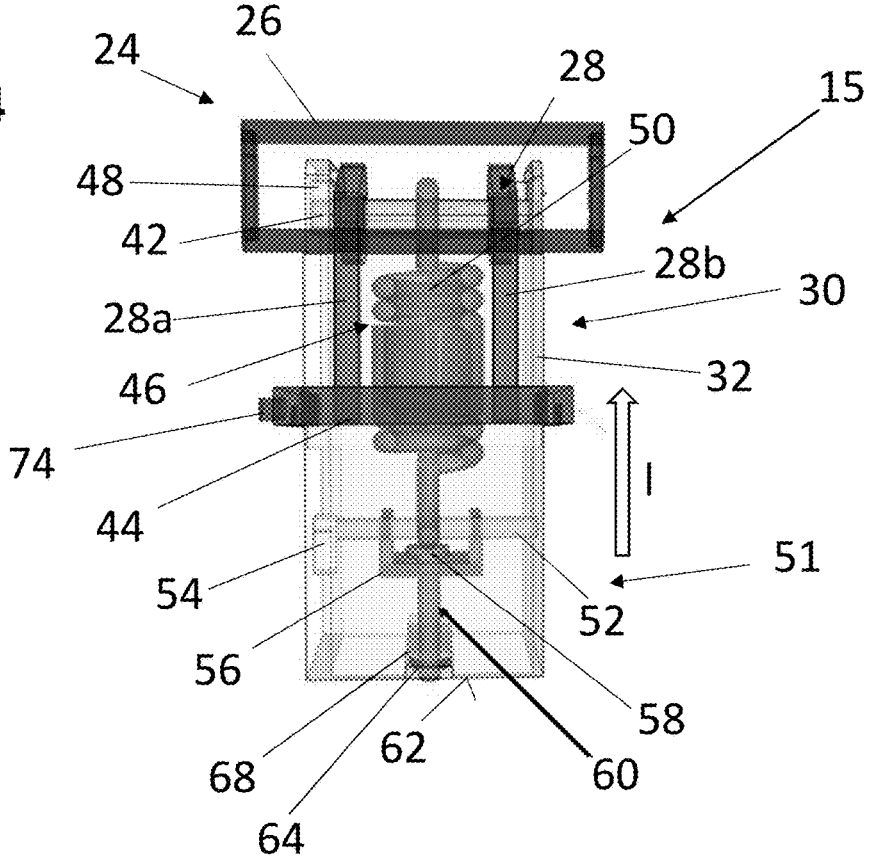
FIG. 4 shows a side view of the fastening part and the engagement part of a device according to any of the claims 1 to 3, with a housing of the fastening part shown as transparent.
Figure 5:
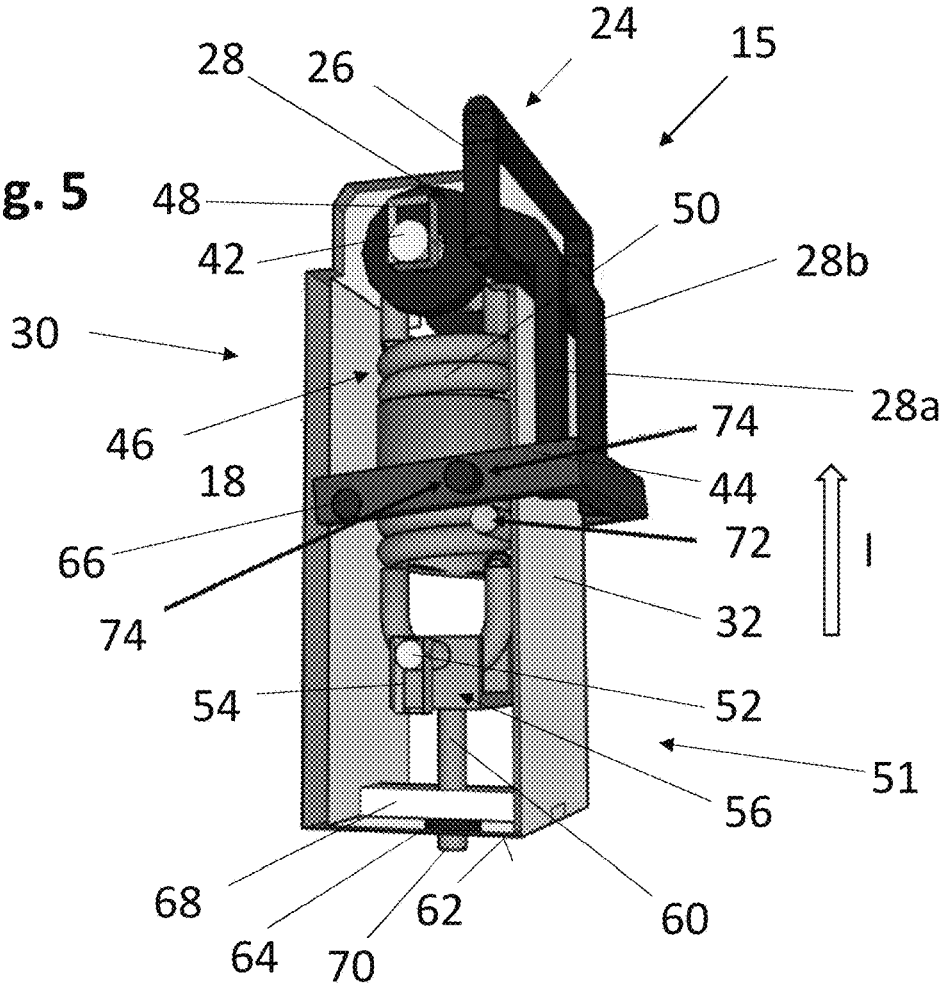
FIGS. 5 and 6 show two perspective views of the fastening part in the engaged position with a secured bail element, which engages behind the engagement element of the engagement part.

FIGS. 4 and 5 show the components of the engagement part 24 and the fastening part 30, and their interaction in greater detail from different perspectives. The housing 32 of the fastening part 30 is transparent in FIG. 4, and in FIGS. 5 and 6 the two opposing side walls of the housing 32 are not shown. The engagement element 26 of the engagement part 24 is in the form of a rectangular torus, through which the bail element 28 in the form of a double bail 28*a*, 28*b* engages, such that the engagement part 24 and thus the first end 18 of the strap 16 is secured in place on the body 12 of the sports equipment 10, particularly such that it cannot tilt.

The securing element 44 is in the form of a rectangular securing bail, which encompasses the oblong, cuboid housing 32 on three sides, and is pivotally supported on a fastening axle 66. The bail can be secured in two securing positions by means of a securing pin 74, wherein the securing pin 74 passes through a bushing 72 in the housing 32 in each of these securing positions, thus retaining the securing bail 44 precisely in the predefined pivotal position. The securing bail is pivoted slightly upward in the first securing position shown therein. In this position, it encompasses the pivot bail 28 independently of the tensile forces acting on the engagement element 26. Even when the pivot axle 42 is deflected into the highest position in the first oblong hole 48, the securing bail 44 secures the pivot bail in the engaged position, such that the connection between the engagement part 24 and the fastening part remains intact independently of the forces acting thereon. The release mechanism 15 is basically deactivated here. In the second securing position (not shown), in which the securing pin 74 engages in the bushing 72 shown in FIGS. 4 and 5, the securing bail is pivoted somewhat further downward. In this position, the pivot bail 28 is released from the securing bail 44 when the tensile force to the engagement element 26 exceeds the releasing tensile force. Lastly, the securing bail 44 can be pivoted downward to a receiving position, in order to encompass the pivot bail 28 when connecting the engagement part and fastening part. It is subsequently pivoted upward into the first or second securing position, and secured therein with the securing pin 74.

The pivot axle 42 of the bail element 28 is supported in the first oblong holes 48 in opposing side walls of the housing such that it can move in the longitudinal direction I of the housing 32. The pivot axle 42 is encompassed by an upper end of the spring element 50, while the lower end of the spring element 50 encompasses an adjustment axle 52 that is transverse to the longitudinal axis of the housing, which is inserted in a second oblong hole 54 in the opposing side walls of the housing 32 such that it can be moved in the longitudinal direction of the housing by means of an adjustment mechanism 51. The adjustment axle 52 is encompassed by a U-shaped carrier profile 56, which has a central hole 58 in which a threaded bolt is non-rotatably retained.

The threaded bolt 60 extends downward from the carrier profile 56 toward the base 62 of the housing, and the central hole passes through a cross web 68 located just above the base of the housing, which is supported in the side walls of the housing. An adjustment nut 64 is screwed onto the end 70 of the threaded bolt 60 extending from the base 62 of the housing above the cross web 68, which then bears on the cross web 68. The releasing force is adjusted by turning the adjustment nut 64, such that the threaded bolt 60 is pulled downward toward the base 62 of the housing to a greater or lesser extent, and the spring element 50 is tensioned accordingly. As a result, the releasing force can be set in a defined manner. The adjustment mechanism 51 thus comprises the adjustment axle 52, the second oblong holes 54 for the adjustment axle 52, the carrier profile 56, the threaded bolt 6, the cross web 68, and the adjustment nut 64.

The securing bail 44 encompasses the second securing position of two legs 28*a, b* of the bail element 28 at their lower ends, such that they are released when the tensile force exerted by the engagement element 26 on the bail element 28 deflects the pivot axle 42 far enough upward in the first oblong hole 48 that when the defined releasing force has been reached, the free ends of the double bail 28*a*, 28*b* are released from the securing bail 44, such that the bail 28 pivots upward and the releases the engagement element 26.

Figure 6:
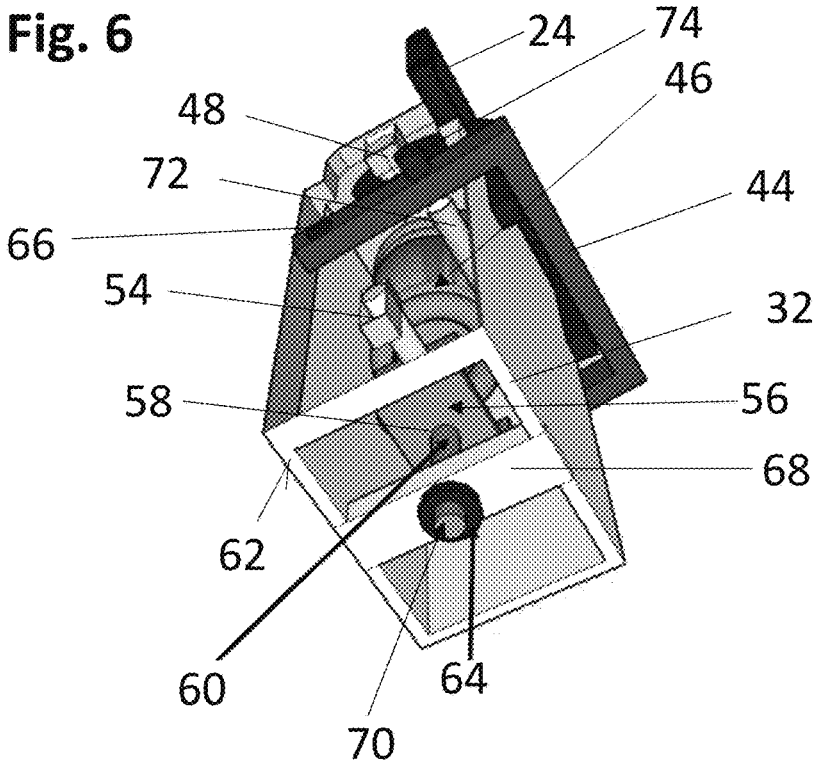
Figure 7:
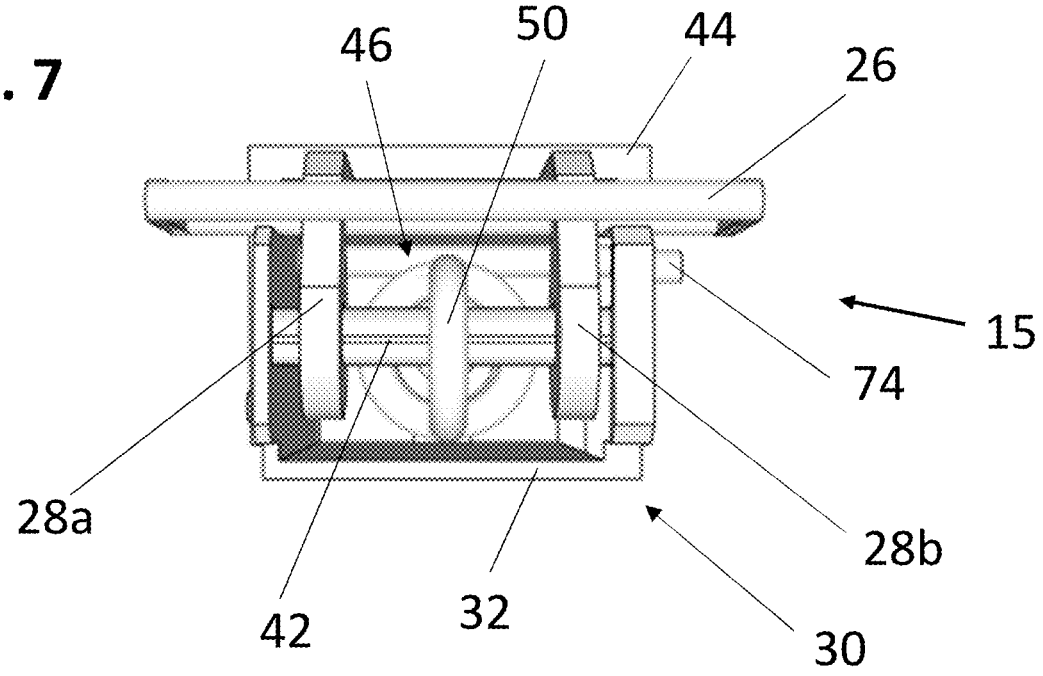
FIG. 7 shows a plan view of the fastening part shown in FIGS. 5 and 6, from above.
Figure 8:
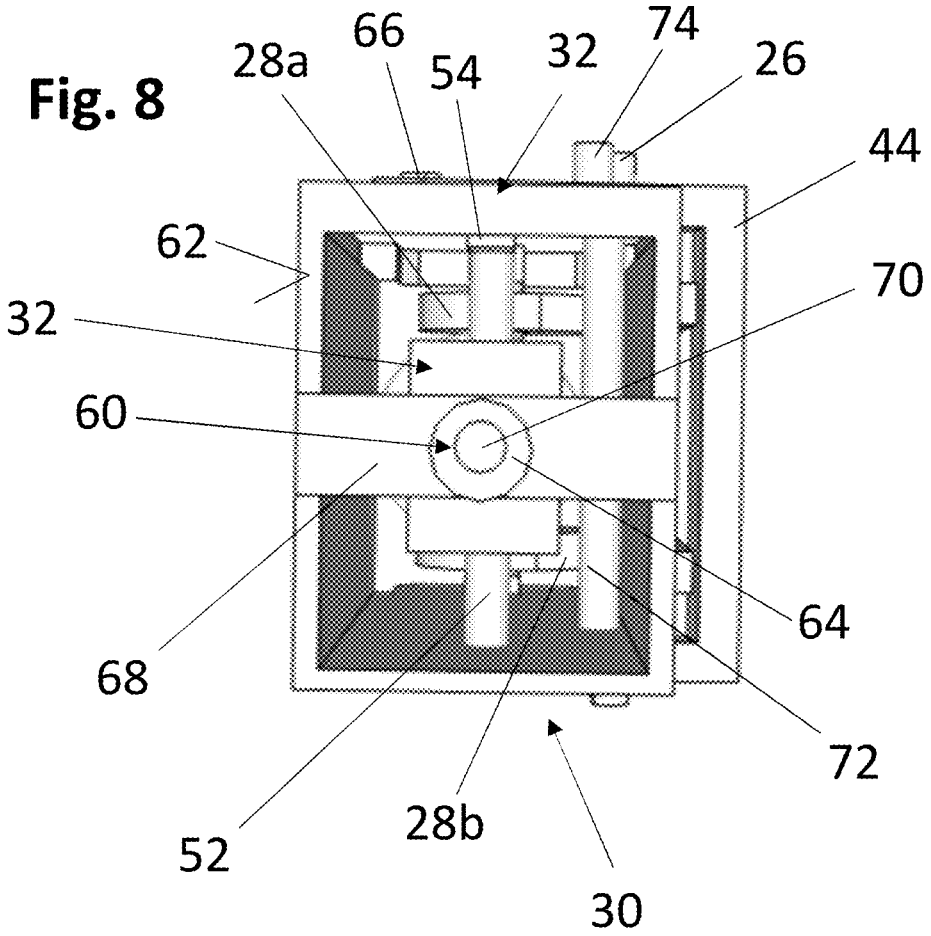
FIG. 8 shows a plan view of the fastening part shown in FIGS. 5 and 6, from below.
Figure 9:
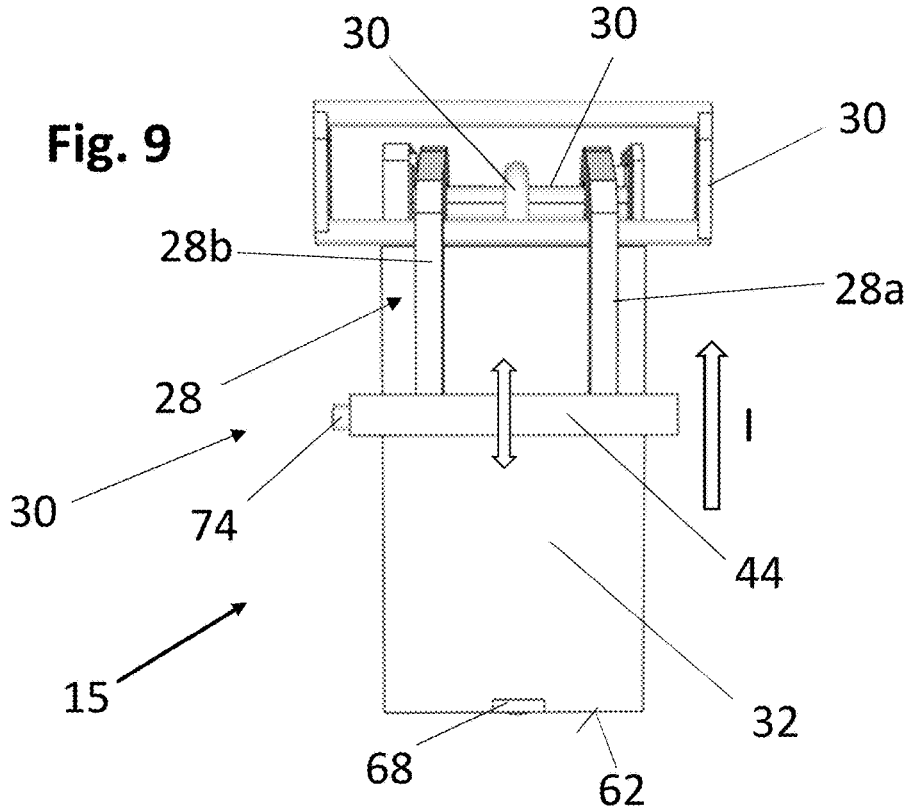
FIGS. 9 and 10 show a side view of the fastening part shown in FIGS. 5 and 6 from two different sides.
Figure 10:
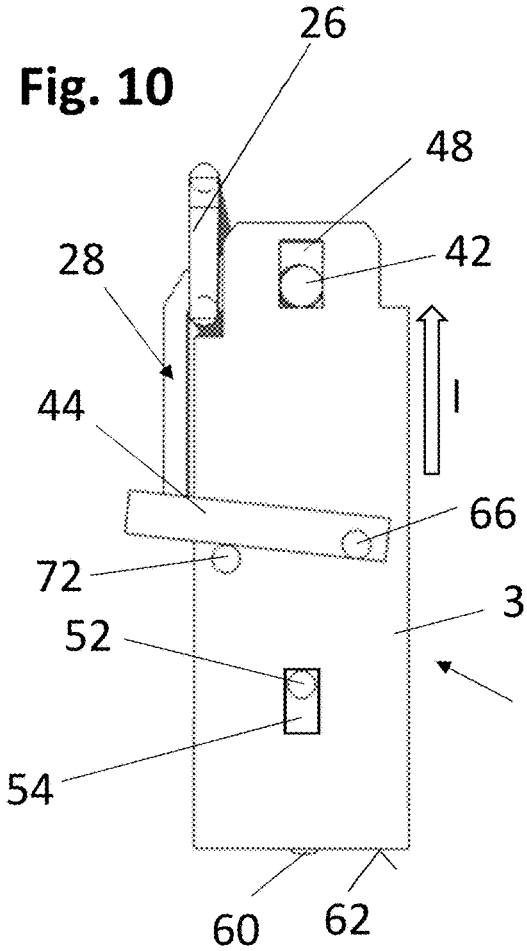
Figure 11:
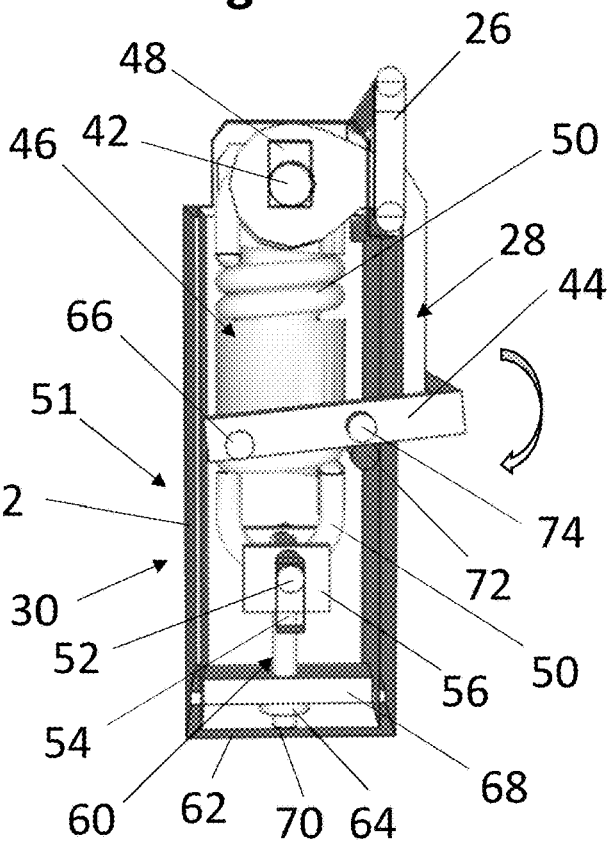
FIG. 11 shows a side view of the fastening part shown in FIG. 10 in a partial cutaway exposing the spring mechanism and the adjustment mechanism.

The following FIGS. 7 to 11 show the release mechanism shown in FIGS. 4 to 6 with the engagement part 24 and fastening part 30 from different perspectives and in side and plan views.

As a matter of course, the engagement element 26 can also be attached to the body 12 of the sports equipment 10, while the fastening part 30 is attached to an end of the strap 16. It is also possible, as a matter of course, for both ends 18, 22 of the strap, or foot strap 16, to be attached to the body 12 of the sports equipment by means of a release mechanism 15.

The invention is not limited to the exemplary embodiments shown herein, but can also be varied arbitrarily. By way of example, the bail element 28 can be in the form of a single bail instead of the double bail described herein, and the engagement element 26 and the securing element can have the form of a ring-torus. The housing 32 is preferably also cylindrical.

The strap or belt 26 can also be rigid or integrated in a larger object, e.g. a snowboard boot or ski boot.

LIST OF REFERENCE SYMBOLS

10 sports equipment
12 body of the sports equipment
14 device for attaching a foot to the sports equipment
15 release mechanism composed of an engagement part and a fastening part
16 strap—flexible fastening element—belt—foot strap
18 first end of the strap
20 mounting plate
22 second end of the strap
24 engagement part
26 engagement element
28 bail element
30 fastening part
32 housing for the fastening part
34 first half of the mounting hinge for supporting the fastening part
36 mounting hinge
38 second half of the mounting hinge for attachment to the body of the sports equipment
40 pivot axle of the mounting hinge, e.g. a film hinge
42 pivot axle for the bail element
44 securing element
46 spring mechanism
48 first oblong holes in the side walls of the housing for the pivot axle
50 spring element—helical spring
51 adjustment mechanism
52 adjustment axle
54 second oblong holes in the side walls of the housing for the adjustment axle
56 U-shaped carrier profile for connecting the spring element and threaded bolt
58 central hole in the carrier profile for receiving the threaded bolt in a non-rotatable manner
60 threaded bolt
62 base of the housing
64 adjustment nut for the adjustment mechanism, bearing on the cross web
66 fastening axle for pivotal support of the securing bail on the housing
68 cross web
70 end of the threaded bolt facing the base of the housing
72 bushing in housing for receiving the securing pin
74 securing pin for securing the two securing positions

What is claimed is:

1. A piece of sports equipment that has a device for attaching an object or a person to the sports equipment, which device has a strap that is secured at its first end to the body of the sports equipment, which strap has a second end that is releasably secured to the body by means of a release mechanism, which release mechanism has a fastening part and an engagement part, which can be releasably connected to one another, wherein one of the two parts is fastened to the body, and the other of the two parts is fastened to the end of the strap, wherein the engagement part has an engagement element that interacts in a form fitting manner with a bail element of the fastening part, wherein the bail element can be pivoted on the fastening part about a pivot axle between an open position that releases the engagement element and an engaged position that engages with the engagement element, wherein the engaged position of the bail element can be secured in place by a securing element, wherein the securing element as well as the bail element are secured to the fastening part, wherein one of the two elements is secured to the fastening part via a spring mechanism, such that the distance between the pivot axle of the bail element and the securing element changes when a tensile load is applied to the bail element, wherein the securing element is in a securing position on the bail element such that it releases the bail element when a defined release force exerted on the bail element has been exceeded.

2. The sports equipment according to claim 1 wherein the spring force of the spring mechanism, and thus the release force, can be adjusted via an adjustment mechanism.

3. The sports equipment according to claim 1 wherein the securing element can be moved between a receiving position and at least one securing position, in which the release mechanism is activated.

4. The sports equipment according to claim 3 wherein the securing element can be secured in a first secured position that deactivates the release mechanism, as well as in a second secured position that activates the release mechanism.

5. The sports equipment according to claim 1 wherein the fastening part has an oblong housing that has a lower fastening region and an upper engagement region, which supports the pivot axle of the bail element, wherein the housing receives the spring mechanism and supports the securing element.

6. The sports equipment according to claim 5 wherein the pivot axle of the bail element is supported in the housing in first oblong holes extending in the longitudinal direction of the housing.

7. The sports equipment according claim 5 wherein the spring mechanism comprises at least one spring that is secured in the fastening region of the housing by means of a mount, and wherein the spring element is connected to the pivot axle of the bail element in the engagement region of the housing, in particular encompassing it.

8. The sports equipment according to claim 7 wherein the spring force of the spring mechanism, and thus the release force, can be adjusted via an adjustment mechanism and wherein the adjustment mechanism is formed in the region of the mount.

9. The sports equipment according to claim 8 wherein the adjustment device comprises an adjustment axle transverse to the longitudinal axis of the housing that is connected to the lower end of the spring element, wherein the position of the adjustment axle can be adjusted in the longitudinal direction of the housing.

10. The sports equipment according to claim 9 wherein the adjustment axle is inserted in the housing in second oblong holes, and retained on a U-shaped carrier, which supports a threaded bolt that passes through a cross web located on the lower end of the housing and bears thereon with an adjustment nut, wherein the position of the adjustment axle can be adjusted in the longitudinal direction of the housing via actuation of the adjustment nut.

11. The sports equipment according to claim 5 wherein the housing is in the form of an oblong rectangular or cylindrical metal or composite fiber housing, wherein the spring element extends in the longitudinal direction of the housing.

12. The sports equipment according to claim 1 wherein a mounting hinge is attached to the body, the first half of which is secured to the body, and its second half, which can be pivoted in relation to the first half, has a releasable connection for securing the fastening part, in particular the housing thereof, or the engagement part.

13. The sports equipment according to claim 12 wherein the connection is formed by a form fitting snap-lock system, which interacts with a side wall of the housing.

14. The sports equipment according to claim 1 wherein the strap is formed by a rigid element, which can be integrated in a coating or a molded element of an object that is to be secured to the body of the sports equipment.

15. The sports equipment according to claim 1 wherein both ends of the strap are secured by means of the release element to the body of the sports equipment.

16. A device for attaching an object or a person to an article of sports equipment having an article body, the device comprising a strap secured at its first end to the article body and a second end that is releasably secured to the article body by a release mechanism, the release mechanism having a fastening part releasably connected to an engagement part, wherein a first of the fastening part and the engagement part is fastened to the article body and a second of the fastening part and the engagement part is fastened to the second end of the strap, wherein the engagement part has an engagement element that interacts in a form fitting manner with a bail of the fastening part, wherein the bail element is pivotable on the fastening part about a pivot axle between an open position that releases the engagement element and an engaged position that engages with the engagement element, wherein the bail element can be secured in the engaged position by a securing element wherein the securing element and the bail element are secured to the fastening part, wherein one of the engagement element or the bail element is secured to the fastening part via at least one spring, such that the distance between the pivot axle of the bail element and the securing element changes when a tensile load is applied to the bail element, wherein the securing element is released from the bail element when a defined release force exerted on the bail element has been exceeded.

17. The device according to claim 16 wherein the fastening part has a housing that has a lower fastening region and an upper engagement region which supports the pivot axle of the bail element, wherein the housing receives the at least one spring and supports the securing element, and the pivot axle of the bail element is supported in the housing in a first set of oblong holes extending in the longitudinal direction of the housing.

18. The device according to claim 17 wherein the at least one spring that is secured in the fastening region of the housing and the at least one spring is connected to the pivot axle of the bail element in the engagement region of the housing.

19. The device according to claim 16 wherein the spring force of the spring, and thus the release force, can be adjusted via an adjustment mechanism comprising an adjustment axle transverse to the longitudinal axis of the housing that is connected to a lower end of the at least one spring, wherein the position of the adjustment axle can be adjusted in the longitudinal direction of the housing.

20. The device according to claim 19 wherein the adjustment axle is inserted in the housing in a second set of oblong holes in the housing, and retained on a U-shaped carrier which supports a threaded bolt that passes through a cross web located on the lower end of the housing and bears thereon with an adjustment nut, wherein the position of the adjustment axle can be adjusted in the longitudinal direction of the housing via actuation of the adjustment nut.

* * * * *